United States Patent [19]

Mok

[11] 4,129,840

[45] Dec. 12, 1978

[54] ARRAY OF DIRECTIONAL FILTERS

[75] Inventor: Chuck K. Mok, Pincourt, Canada

[73] Assignee: RCA Corporation, New York, N.Y.

[21] Appl. No.: 810,875

[22] Filed: Jun. 28, 1977

[51] Int. Cl.[2] ..... H01P 1/20; H01P 7/06; H01P 1/00

[52] U.S. Cl. ..... 333/73 W; 333/83 R; 333/98 R

[58] Field of Search ..... 333/8, 73 C, 73 W, 73 R, 333/73 S, 83 A, 83 T, 83 R, 98 R

[56] References Cited

U.S. PATENT DOCUMENTS

| | | | |
|---|---|---|---|
| 2,823,356 | 2/1958 | Miller | 333/73 W |
| 4,028,651 | 6/1977 | Leetman | 333/73 W |

OTHER PUBLICATIONS

Atia, A. E. and Williams, A. E., *Narrow-Bandpass Waveguide Filters*, IEEE Trans., vol. MTT-20, No. 4, Apr. 1972, pp. 258-265.

*Primary Examiner*—Alfred E. Smith

*Assistant Examiner*—Harry E. Barlow

*Attorney, Agent, or Firm*—H. Christoffersen; Joseph D. Lazar

[57] ABSTRACT

A transponder includes twelve directional filters that operate in both band stop and band pass modes. The pass and stop bands of each filter has a center frequency that is substantially the same as the center frequency of one of twelve signal channels of the transponder, whereby each channel corresponds to a filter. The twelve filters are connected to a rectangular waveguide at selected relative displacements from a downstream end thereof. Signals within one of two groups of six alternate adjacent channels are propagated through their corresponding filters and through the downstream end without either an undesired signal loss or an undesired group delay. Signals within five channels of the other group are propagated through their corresponding filters and through the downstream end with a symmetrical loss of the highest and lowest frequency portions thereof.

4 Claims, 6 Drawing Figures

ARRAY OF DIRECTIONAL FILTERS

CROSS REFERENCE TO COPENDING U.S. APPLICATION

U.S. patent application Ser. No. 797,404, filed May 16, 1977, entitled "Dual Mode Filter," based on the invention of Chuck Kng Mok.

BACKGROUND OF THE INVENTION

1. Field of Invention

This invention relates to microwave filters and more particularly to an array of directional filters.

2. Description of the Prior Art

A man made satellite that orbits about the earth is often used to transmit a message to the earth. Typically, the message is transmitted by a transponder that is aboard the satellite.

In one type of transponder, the message is a modulated signal that has a frequency within one of twelve signal channels. The channels are bands of frequencies of approximately 36 MHz within a broad band that extends from 3.7 GHz to 4.2 GHz. There is usually a guard band of approximately four MHz between adjacent channels.

The transponder additionally includes twelve travelling wave tube amplifiers that respectively amplify message signals within the twelve channels. The outputs of the amplifiers are connected to an antenna through twelve band pass filters, respectively. The pass bands of the twelve filters are substantially equal to the twelve channels whereby the filters reject noise generated by the amplifiers. Therefore, each filter corresponds to a channel.

When an amplified message signal passes through a filter with a phase shift that is linearly proportional to the frequency of the amplified message signal, the filter provides an undistorted output. The rate of change of the phase shift with respect to the frequency is known as the group delay of the amplified message signal. When the phase shift is linearly proportional to the frequency, the group delay is constant.

When two filters, corresponding to adjacent channels, have their outputs connected together, there is usually an undesired interaction between the two filters. The interaction occurs because the adjacent channels are separated by only the four MHz guard band. The interaction causes a variation of the group delay of amplified message signals within the corresponding adjacent channels. Additionally, the interaction causes the connected filters to have distorted pass bands. To obviate the variation of the group delay and the distortion of the pass bands, the twelve filters are formed into first and second groups of six filters that are connected to first and second ports, respectively, of the antenna.

The first group of filters correspond to six alternate adjacent channels, whereby the second group also corresponds to six alternate adjacent channels. Accordingly, both of the antenna ports receive signals of alternate adjacent channels, thereby obviating the variation of the group delay and the distortion of pass bands. However, because the antenna has two ports, the design of the antenna is complex.

SUMMARY OF THE INVENTION

According to the present invention, at least three directional filters are each operable to filter a corresponding channel of frequencies. All of the filters are connected to a wall of a waveguide at differing distances from an end of the waveguide. The filters closest to the end are in a group of the filters that correspond to consecutive alternate adjacent channels. The number of filters in the group equals the greatest number of consecutive alternate adjacent channels.

DESCRIPTION OF THE PREFERRED EMBODIMENT

Figure 1:
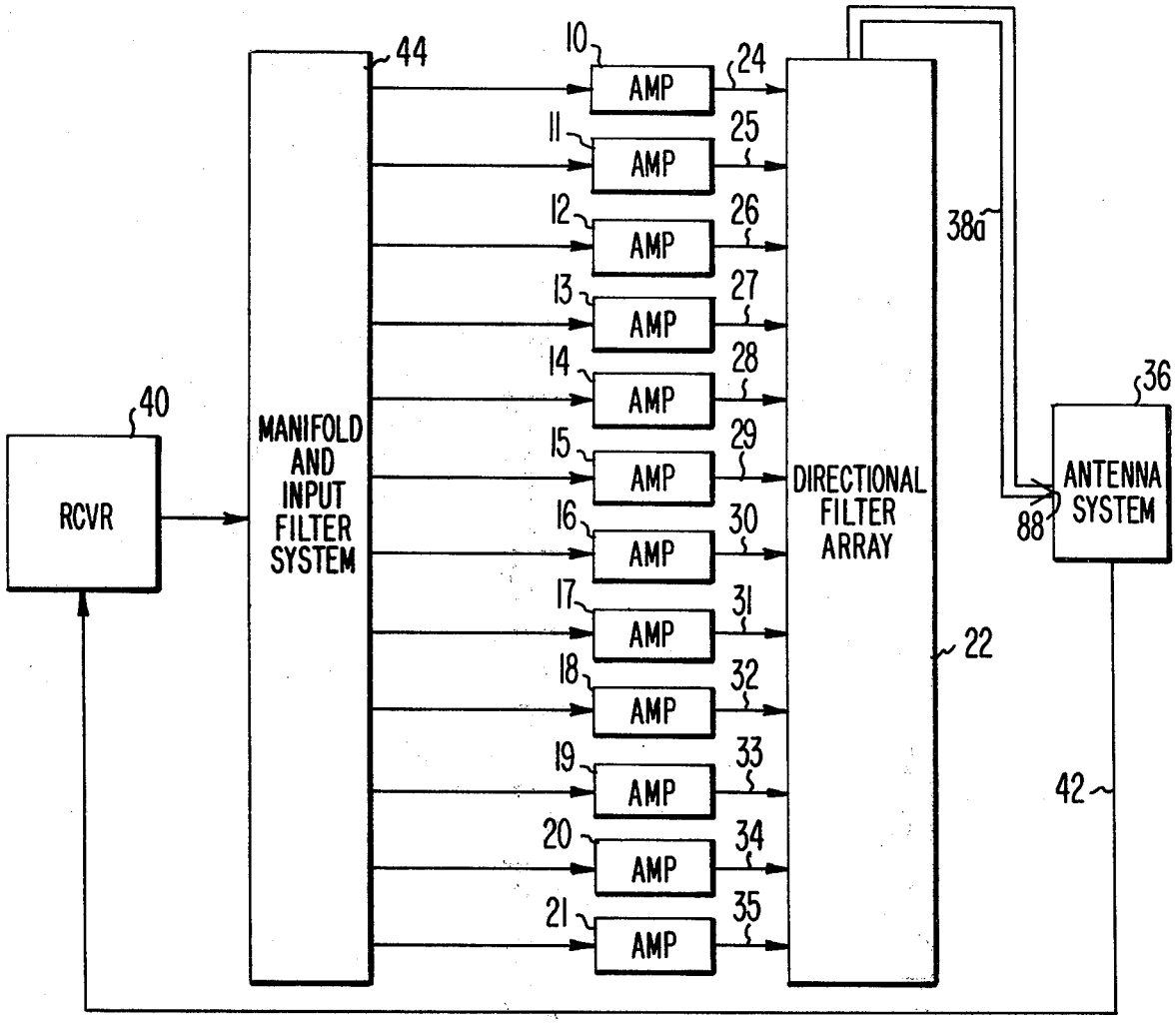
FIG. 1 is a block diagram of a preferred embodiment of the present invention.

As shown in FIG. 1, a transponder includes twelve travelling wave tube amplifiers 10–21 that have their outputs connected to a filter array 22 through signal lines 24–35, respectively. The output of filter array 22 is connected to an input port of antenna system 36 through a rectangular waveguide **38*a*. Array 22** comprises twelve directional filters.

The transponder additionally includes a receiver 40 that has an input connected to antenna system 36 through a signal path 42. Receiver 40 has an output connected through a manifold and input filter system 44 to the inputs of amplifiers 10–21. A suitable filter system 44 is described in the aforementioned copending U.S. patent application.

In response to antenna system 36 receiving a signal from a ground station (not shown), receiver 40 provides a message signal to one of the amplifiers 10–21 via system 44, thereby causing an amplified message signal to be provided through array 22 to antenna system 36. The amplified message signal causes a corresponding radiation of electromagnetic energy by antenna system 36.

Figure 2:
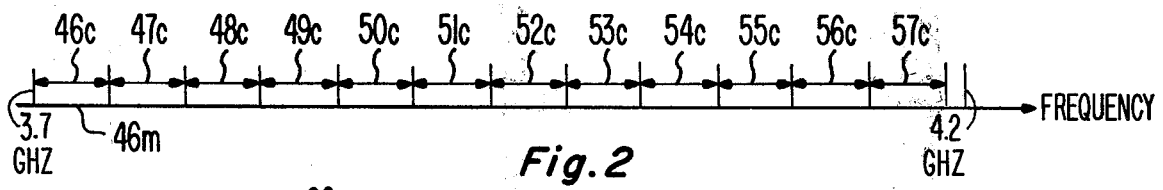
FIG. 2 is a graphic representation of frequency channels of a transponder in the embodiment of FIG. 1.

As shown in FIG. 2, frequencies of all amplified message signals are within one of twelve contiguous signal channels **46*c*–57*c* which are bands of frequencies within a broad band that extends from 3.7 GHz to 4.2 GHz. Each of the channels 46*c*–57*c* has a nominal bandwidth of 40 MHz. Channels 46*c*–47*c* are not separated by guard bands. In this embodiment, message signals within channels 46*c*–57*c* are provided by system 44 (FIG. 1) to the inputs of amplifiers 10–21, respectively. Amplified message signals within channels 46*c*–57*c* are provided to array 22 by amplifiers 10–21, respectively. Amplifiers 10–21 may introduce distortion into an amplified message signal. Array 22 rejects the distortion and provides all amplified message signals to antenna 36 via waveguide 38*a*** as explained hereinafter.

Figure 3:
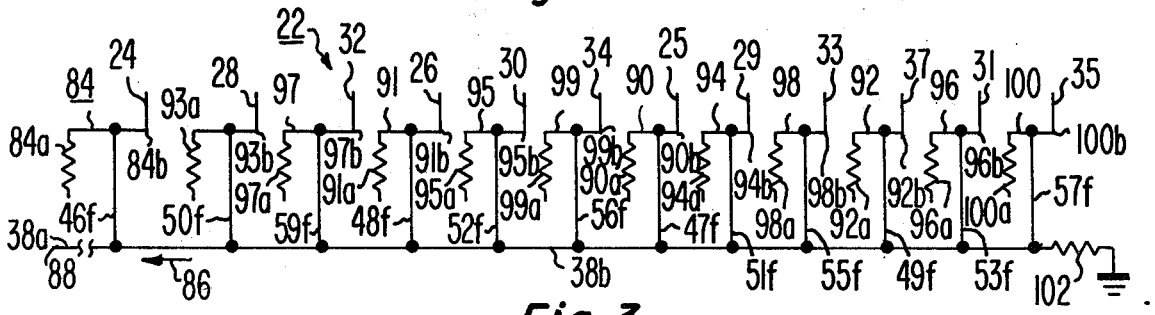
FIG. 3 is a schematic diagram of an array of directional filters in the embodiment of FIG. 1.
Figure 4:
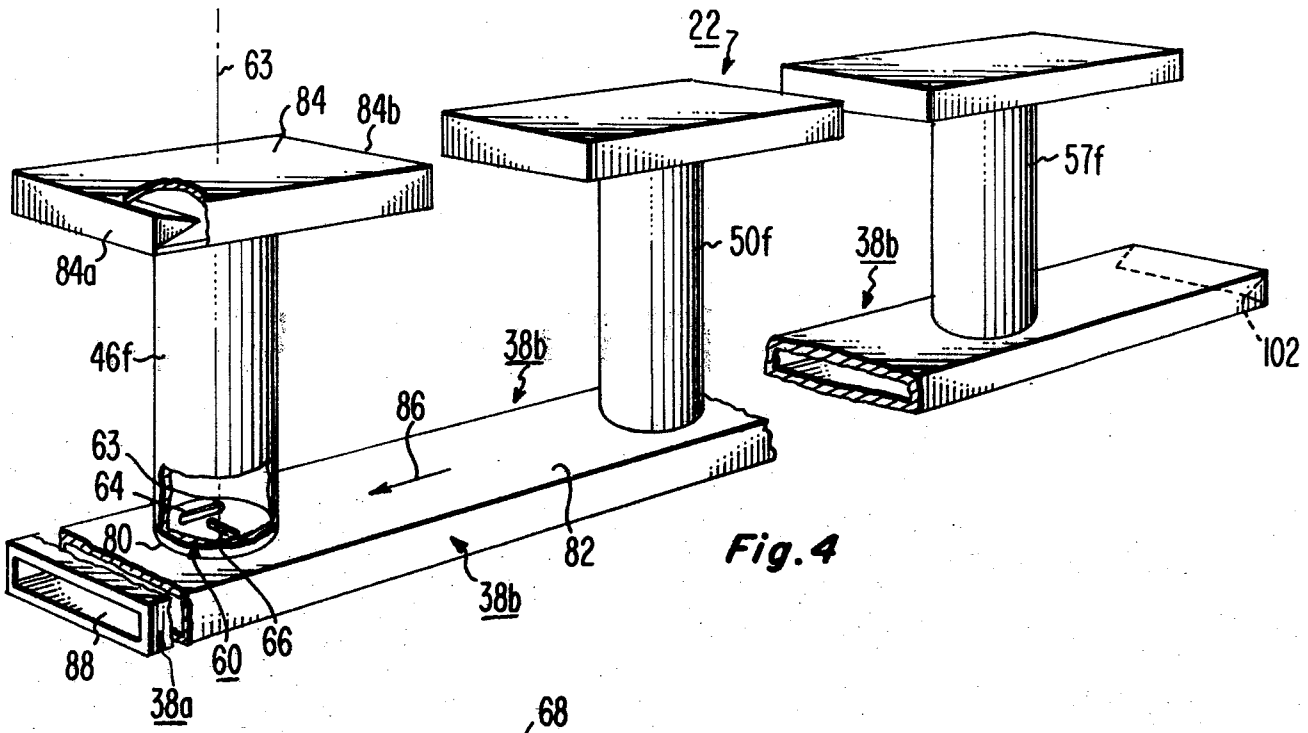
FIG. 4 is a perspective view with parts broken away of some of the filters of FIG. 3.
Figure 5:
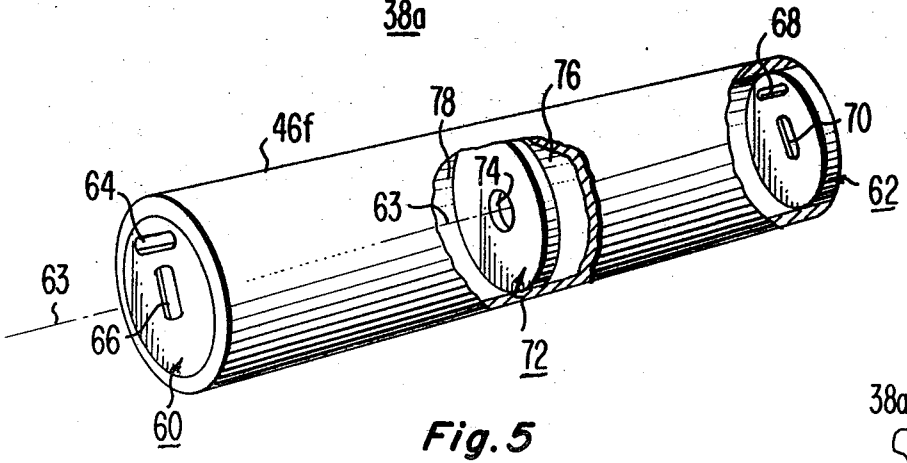
FIG. 5 is a perspective view, with parts broken away, of one of the filters of FIG. 4.

As shown in FIGS. 3–5, array 22 is comprised of directional filters **46*f*–57*f* (FIG. 4) which are all of generally similar construction. Exemplary of filters 46*f*–57*f*, filter 46*f* (FIG. 5) is a circular waveguide with end walls 60 and 62 that are perpendicular to a central axis 63 of filter 46*f*. End wall 60 has passing therethrough a round ended slot 64 and a round ended slot 66. Slots 64 and 66 are both offset from axis 63. Additionally, slot 64 is perpendicular to slot 66 and at a known distance therefrom. Slots 64 and 66** form a hybrid slot pair of a type that is well known in the microwave art.

Similar to slots 64 and 66, a round ended slot 68 and a round ended slot 70 form a hybrid slot pair which pass through end wall 62. Slots 68 and 70 are respectively parallel to slots 64 and 66. Therefore, end plates 60 and 62 include hybrid slot pairs that have similar orientations about axis 63.

Filter **46*f* additionally includes a disc shaped metal coupling obstacle 72 that has a circular central hole 74 therethrough. Alternatively, filter 46*f* may include a coupling obstacle with slots of equal length that intersect perpendicularly to form a single slot in the shape of a cruciform, well known in the art but not shown here. As explained hereinafter, filter 46*f* has two modes of operation. In one mode, filter 46*f* is a band pass filter. In the other mode, filter 46*f* is a band stop filter. Moreover, the bandwidth of the stop and the pass bands are the same. The bandwidth of the pass and stop bands is determined by the size of hole 74 and the shape of slots 64, 66, and 70** in a manner well known in the art. The pass and stop bands of a directional filter are collectively referred to hereinafter as the resonant frequency band of the filter.

Coupling obstacle 72 is mounted midway between end walls 60 and 62, thereby forming cavities 76 and 78. The axial lengths of cavities 76 and 78 are equal to one half of the wavelength associated with the center frequency **46*m* (FIG. 2) of channel 46*c*. Because of the axial lengths of cavities 76 and 78, the center of the resonant frequency band of filter 46*f* is substantially equal to frequency 46*m*. Moreover, because filter 46*f*** includes two cavities, it is a second order filter that is conceptually similar to a second order low pass prototype filter. An alternative embodiment may include directional filters of any desired order. As known in the art, the order of a filter equals the number of singularities in a transfer function that is representative of the filter. Thus, a second order low pass filter may be represented by a transfer function having two singularities.

As stated hereinbefore, waveguide **38*a* is connected to the output of array 22 to antenna system 36. End wall 60 is integrally connected to waveguide 38*b* (FIG. 4) through a port 80 within a wall 82 of waveguide 38*b*. Additionally, filter 46*f* is oriented with axis 63 perpendicular to wall 82 and with slot 64 parallel to the top, bottom, and side walls of waveguide 38*b***.

End wall 62 is integrally connected (in the same manner as the connection of end wall 60) to a waveguide 84 through a port (not shown), similar to port 80, within a bottom wall (not shown) of waveguide 84. Filter **46*f* is oriented with axis 63 perpendicular to the bottom wall of waveguide 84 and with slot 68 parallel to the top, bottom, and side walls of waveguide 84**.

Waveguide 84 has a closed end **84*a* that is in the general shape of a wedge extending into the cavity of waveguide 84. End 84*a* is comprised of a solid solution of iron oxide powder in epoxy, thereby forming a well known type of waveguide termination. The concentration of the solution causes the impedance of the termination to be the characteristic impedance of waveguide 84. Thus, there can be no reflection of signals from end 84*a*; all signals propagated within waveguide 84 to end 84*a* are dissipated therein. In addition to end 84*a*, waveguide 84 has an open end 84*b***.

In the description of this embodiment, the direction of arrow 86 is referred to as a downstream direction. Additionally, antenna system 36 has a port connected in any suitable manner to what is referred to as a downstream end 88 of waveguide **38*a* (FIG. 1). However, as explained hereinafter, in an alternative embodiment signals are provided to array 22 from a source connected to end 88**.

The operation of filter **46*f* is understood by considering propagation thereto of an exemplary signal received via receiver 40. The exemplary signal is comprised of electromagnetic field components that have substantially all of the frequencies within the broad band (3.7–4.2 GHz). When the exemplary signal is propagated through waveguide 38*b* in the downstream direction towards filter 46*f*, the orientation of slots 64, 66, 68, and 70 and the resonant frequency band of filter 46*f* causes substantially the entire component of the exemplary signal within channel 46*c* to be propagated via filter 46*f* and waveguide 84 to end 84*a* where it is dissipated; all other components of the exemplary signal are propagated downstream through end 88. Therefore, filter 46*f* operates as a band stop filter that rejects signals within channel 46*c* that are propagated thereto via waveguide 38*b***.

It should be understood that the input impedance of antenna system 36 substantially equals the characteristic impedance of waveguide **38*a*. Therefore, there is substantially no reflection of signals propagated through end 88**.

When the exemplary signal is propagated through waveguide 84 from end **84*b*, the orientation slots 64, 66, 68, and 70 and the resonant frequency band of filter 46*f* causes substantially the entire signal component within channel 46*c* to be propagated through filter 46*f* and downstream through end 88; all other components of the exemplary signal are propagated through waveguide 84 to end 84*a* where they are dissipated. Therefore, filter 46*f* operates as a band pass filter that passes signals within channel 46*c* that are propagated thereto from end 84*b*. Thus, filter 46*f* functions as a band stop filter for signals received via port 80 and functions as a band pass of signals received via end 84*b***.

Corresponding to filter **46*f*, filters 47*f*–57*f*, each include two cavities that have axial lengths equal to one half of the wavelength associated with the center frequencies of channels 47*c*–57*c*, respectively. Accordingly, filters 46*f*–57*f* are respectively associated with channels 46*c*–57*c***.

Filters **47*f*–57*f* additionally have slots within end walls thereof corresponding to slots 64, 66, 68, and 70. Additionally, filters 47*f*–57*f* have coupling obstacles corresponding to coupling obstacle 72. The bandwidths of the resonant frequency bands of filters 58*b*–58*l*** is described hereinafter.

In a manner similar to that described in connection with filter **46*f*, filters 47*f*–57*f* all have one end connected to waveguide 38*b*. The placement of filters 46*f*–57*f* relative to each other and to end 88 is as shown in FIG. 3. The other end of filters 47*f*–57*f* are connected to waveguides 90–100, respectively. Waveguides 90–100 are each similar to waveguide 84. The connection of waveguides 90–100 to filters 47*f*–57*f* is similar to the connection of filter 46*f* to waveguide 84**.

Waveguides 90–100 have ends **90*a*–100*a*, respectively, that are similar to end 84*a*. Additionally, waveguides 90–100 have ends 90*b*–100*b*, respectively, that are similar to end 84*b*. Ends 84*b* and 90*b*–100*b* are connected to amplifiers 10–21 through signal lines 24–35, respectively. Because the input impedance of antenna system 36 substantially equals the characteristic impedance of waveguide 38a, the spacing between filters 46f–57f** is not critical.

It should be appreciated that when the exemplary signal is propagated through waveguide 38b to filter 47f, there may be an undesired rejection of a portion of the component that includes the lowest frequencies within channel 47c. The undesired rejection is a result of the resonant frequency band of filter 46f undesirably extending into channel 47c, which is the channel adjacent to channel 46c. The undesired rejection may be compensated for by a network at the ground station that receives radiation from antenna system 36. Since most networks have a symmetrical response to applied signals, it is desirable that filter 47f respond symmetrically to the amplified message signals. Therefore, when a low frequency portion of a message signal within channel 47c is undesirably rejected, it is desirable to reject a corresponding high frequency portion thereof. Rejection of corresponding portions of message signals is provided as explained hereinafter.

According to the present invention, in an array of directional filters, the filters most downstream correspond to consecutive alternate adjacent channels. The number of filters most downstream equals the greatest number of consecutive alternate adjacent channels. Since array 22 is comprised of twelve filters corresponding to twelve adjacent channels, in this embodiment the greatest number of "consecutive alternate adjacent channels" equals six. Filters 46f, 48f, 50f, 52f, 54f, and 56f, which correspond to "consecutive alternate adjacent channels," are the most downstream of the filters of array 22.

Because filters 46f, 48f, 50f, 52f, 54f, and 56f are the most downstream of the twelve filters of array 22, there is substantially no rejection of portions of amplified message signals within the corresponding channels 46c, 48c, 50c, 52c, 54c, and 56c. However, when an amplified message signal within channel 47c is propagated through filter 47f and downstream towards end 88, the highest and lowest frequency portions of the amplified message signal may be rejected by filters 48f and 46f, respectively. In a similar manner, amplified message signals that pass through filters 49f, 51f, 53f, and 55f have high and low frequency portions that may be rejected. In summary, there is substantially no rejection of any portion of an amplified message signal that pass through six of the filters of array 22. There may be a rejection of corresponding high and low frequency portions of message signals that pass through five of the filters of array 22.

The most constant group delays of amplified message signals are attained when the resonant frequency bands of filters 46f–57f have as large a bandwidth as feasible. The bandwidths are as large as feasible when each of the filters 46f–57f has a resonant frequency band that includes the channel corresponding thereto and substantial portions of adjacent channels that correspond to those of filters 46f–57f that are downstream therefrom. Downstream from filter 47f, for example, are filters 46f, 50f, 54f, 48f, 52f, and 56f. Therefore, to attain the most constant group delay, filter 47f has a resonant frequency band that includes channel 47c, and substantial portions of channels 46c and 48c; undesired signals within channels 46c and 48c that pass through filter 47f are rejected downstream by filters 46f and 48f, respectively.

Usually, a travelling wave tube amplifier causes intermodulation distortion of an amplified signal, thereby introducing distortion at its output. Amplifier 21 (FIG. 1), for example, may introduce a distortion signal that has a frequency within any of the signal channels 46c–57c. Although the band pass characteristics of filter 57f causes a rejection of components of the distortion signal having frequency within channels 46c–56c, the band stop characteristics of filters 46f–56f causes an additional rejection of the components of the distortion signal during their propagation downstream. Therefore, because of the band stop characteristics of filters 46f–56f, there is a rejection of distortion signals that may be caused by intermodulation distortion.

Mechanical imperfection of components that comprise array 22 may cause portions of an amplified message signal to be propagated upstream through waveguide 38b. In this embodiment, waveguide 38b has an upstream end 102 comprised of a termination similar to that described in connection with end 84a (FIG. 4). Therefore, when a portion of an amplified message signal propagated upstream to end 102, it is dissipated.

Figure 6:
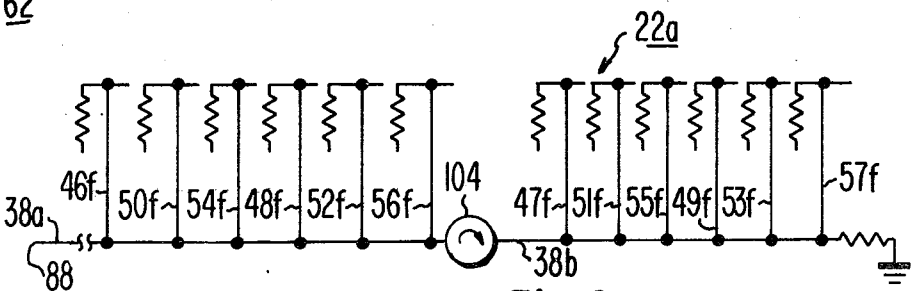
FIG. 6 is a schematic diagram of an alternative array of directional filters.

Mechanical imperfections of hybrid slots may cause undesired reflections of portions of amplified message signals from hybrid slots of filters 46f–57f, thereby causing a build-up of standing waves within waveguide 38b. As shown in FIG. 6, in an array 22a, such a build-up of standing waves is reduced by including a circulator 104 of any suitable type in series with waveguide 38b. Circulator 104 provides a unidirectional signal path in the direction of arrow 86.

It should be understood that array 22 (FIG. 1) is a linear bilateral network. Therefore, in an alternative embodiment, end 88 may be connected to a signal source that provides input signals having frequencies within channels 46c–57c. In response to the input signals, waveguides 84 and 90–100 provide output signals having frequencies within channels 46c–57c, respectively.

Thus, there is described hereinbefore an array of twelve directional filters that provides amplified message signals through one port, e.g., end 88. The filters are for filtering twelve contiguous channels, without guard bands, within a broad band. Although the channels are contiguous, there is substantially no rejection of amplified message signals propagated through six of the filters and a symmetric rejection of amplified message signals propagated through five of the filters.

What is claimed is:

1. A filter array for filtering first, second and third contiguous channels of frequencies where frequencies of said third channel are higher than frequencies of said second channel and frequencies of said second channel are higher than frequencies of said first channel, comprising:

a first directional filter having a resonant frequency band that includes said first channel;

a second directional filter having a resonant frequency band that includes said second channel and substantial portions of said first and third channels;

a third directional filter having a resonant frequency band that includes said third channel and a substantial portion of said first channel, all of said filters being of a type that has an end wall with a hybrid slot pair;

a rectangular waveguide having an end adapted for connection to a source and to a load, and a wall with first, second and third ports, said first and second ports being respectively closest to and furthest from said waveguide end, said end walls of said first, second and third filters being connected to said first, second and third ports, respectively, in a manner that causes a signal that passes through said filters to said waveguide to propagate towards said waveguide end.

2. The array of claim 1 additionally comprising a circulator connected in series with said waveguide.

3. A transponder that provides signals within first, second and third contiguous channels of frequencies to an antenna system via first, second and third travelling wave tube amplifiers, respectively, frequencies of said third channel being higher than frequencies of said second channel and frequencies of said second channel being higher than frequencies of said first channel, comprising:

a rectangular waveguide having an end connected to said antenna system, and a wall with first, second and third ports, said first and second ports being respectively closest to and furthest from said waveguide end;

a first directional filter that has a resonant frequency band which includes said first channel, said first filter having a port connected to the output of said first amplifier;

a second directional filter that has a resonant frequency band which includes said second channel and portions of said first and third channels, said second filter having a port connected to the output of said second amplifier;

a third directional filter that has a resonant frequency band which includes said third channel and portions of said first channel, said third filter having a port connected to the output of said third amplifier, said first, second and third filters having hybrid slot pairs connected to said first, second and third ports, respectively, of said waveguide in a manner that causes a signal that passes through said filters to said waveguide to propagate to said antenna system.

4. The transponder of claim 3 additionally comprising a circulator connected in series with said waveguide.

* * * * *